US005284462A

United States Patent [19]

Olschansky et al.

[11] Patent Number: 5,284,462

[45] Date of Patent: * Feb. 8, 1994

[54] BODY EXERCISING APPARATUS

[76] Inventors: Brad Olschansky; Scott Olschansky, both of 2077 Lake Park Dr., Apt. C, Smyrna, Ga. 30080; Raymond H. Lee, Jr., 11737 Greenspring Ave., Lutherville, Md. 21093

[ * ] Notice: The portion of the term of this patent subsequent to Sep. 8, 2009 has been disclaimed.

[21] Appl. No.: 941,237

[22] Filed: Sep. 4, 1992

Related U.S. Application Data

[63] Continuation-in-part of Ser. No. 679,958, Apr. 3, 1991, Pat. No. 5,145,479.

[51] Int. Cl.[5] ..... A63B 21/00

[52] U.S. Cl. ..... 482/62; 482/64

[58] Field of Search ..... 482/51, 62, 57, 72, 482/63, 64, 114; 128/25 R

[56] References Cited

U.S. PATENT DOCUMENTS

| | | | |
|---|---|---|---|
| 4,684,126 | 8/1987 | Dalebout et al. | 482/72 |
| 4,741,527 | 5/1988 | Nestegard | 482/62 |
| 4,923,193 | 5/1990 | Pitzen et al. | 482/72 |
| 5,016,870 | 5/1991 | Balloch et al. | 482/62 |
| 5,125,648 | 6/1992 | Olschansky et al. | 482/62 |
| 5,145,479 | 9/1992 | Olschansky et al. | 482/62 |

*Primary Examiner*—Stephen R. Crow

*Attorney, Agent, or Firm*—Morton J. Rosenberg; David I. Klein

[57] ABSTRACT

A body exercising apparatus (10) is provided which allows for individual and combinational exercising of an upper body portion (12) and a lower body portion (14) of a user (16). The body exercising apparatus (10) includes a frame (18) having opposing and longitudinally displaced front and rear sections (22 and 24). There is provided an upper body exercising mechanism (46) which allows the user to grip a pair of hand grip members (54) and rotatively actuate a pair of hand actuated rotating shafts (50) through a crank arm joint mechanism (60) in a variety of orientations with respect to frame (18). Additionally, there is provided a lower body or foot positioning mechanism (90) which allows for adjustable force rotation by a pair of pedal members (96). Through use of independently operated upper body and lower body frictional adjustment mechanisms (80 and 114), the user has at his or her disposal an overall exercising apparatus (10) where a variety of muscles in both the upper and lower body (12 and 14) may be exercised.

18 Claims, 2 Drawing Sheets

BODY EXERCISING APPARATUS

CROSS-REFERENCE TO RELATED PATENT DOCUMENTS

This patent application is a continuation-in-part of Ser. No. 07/679,958, now U.S. Pat. No. 5,145,479, filed on Apr. 3, 1991 entitled "Total Body Exercising Apparatus".

INCORPORATION BY REFERENCE

This patent application hereby incorporates by reference U.S. Pat. No. 5,125,648, issued on Jun. 30, 1992, and entitled "Upper Body Exercise System".

BACKGROUND OF THE INVENTION

1. Field of the Invention

This invention is directed to a body exercising apparatus which independently and combinatorily exercises the upper and lower body portions of a user. Particularly, this invention is directed to an exercising apparatus which includes an upper body mechanism actuated by rotational displacement of a pair of rotary shafts extending from the housing of an overall frame member. Still further, this invention directs itself to an exercising apparatus where the upper body exercising is provided by an adjustable crank arm mechanism which may be positionally oriented in numerous planes with respect to the exercising apparatus housing. Still further, this invention relates to an exercising apparatus where an adjustable crank mechanism may be actuated by the arms of the user in a rotative displacement responsive to an adjustable frictional force setting applied by the user. Still further, this invention relates to an exercising apparatus which includes a stationary frame having a seat member where the user may position his or her feet in a frontal section of the frame. More in particular, this invention directs itself to a body exercising apparatus whereby there is provided a lower body exercising mechanism actuated by rotary displacement of pedal members which are coupled to a lower body friction mechanism. Still further, this invention relates to a body exercising apparatus where a lower body exercising mechanism is provided with an adjustable frictional force adjustment to allow the user to apply varying and determinative forces to his or her lower body independently or in combination with an upper body exercising mechanism.

2. Prior Art

Exercise systems using rotary crank assemblies are well-known in the art. The best prior art known to Applicant includes U.S. Pat. Nos. 4,582,318; 4,402,502; 3,966,201; 3,759,512; 3,570,477; 3,216,722; 3,213,852; 3,057,201; 3,017,180; 1,909,002; 1,820,372; 797,814; 3,017,180; 4,932,650; and, 5,016,870.

In some prior art systems, such as that disclosed in U.S. Pat. No. 4,582,318, only singular body portions may be exercised. Other prior art systems in the form of stationary bicycles generally exercise the lower body portions of a user. However, in other prior art systems, such as that disclosed in the aforementioned U.S. Patent, there are provided systems which are provided to exercising just the upper body of the user. In use of such prior art systems, a user when he or she wishes to exercise both upper and lower body portions, must do so separately and on separate exercising apparatus. However, in the subject Patent Application, there is disclosed a resistance assembly wherein rotatable members associated with both the upper body portions of the user may be exercised either singularly or in combination.

In other prior art systems such as those disclosed in U.S. Pat. Nos. 1,820,372; 1,909,002; 3,017,180; 3,213,852; 3,216,722; 3,570,477; and, 4,402,502, there are disclosed systems which incorporate both upper and lower body exercising crank assemblies. In such systems, some of which are motor assisted, both upper and lower body crank assemblies are mechanically coupled together for simultaneous operation. These systems generally incorporate a single resistive force assembly against which both the upper and lower body portions of the user must exercise and none of these prior art systems provide for the unique adjustability as to orientation and positioning of force loads, as is provided in the subject invention concept.

SUMMARY OF THE INVENTION

A body exercising apparatus is provided which incudes a frame including a central frame member having an inverted substantially U-shaped contour. The frame member has opposingly and longitudinally displaced front and rear sections. A seat mechanism for supporting the body of a user is provided with the seat mechanism being coupled to an upper surface of the frame adjacent the rear section of the frame. A mechanism is provided for positioning the user's feet adjacent the front section of the frame in longitudinally spaced relation with respect to the seat mechanism. There is further provided a mechanism for exercising an upper body portion of the user. The upper body exercising mechanism is positionally located adjacent the rear section of the frame substantially beneath the seat mechanism. The upper body exercising mechanism includes a hand actuated rotary crank mechanism for rotation in either of two opposite rotary directions as well as an upper body resistance mechanism coupled to the hand actuated rotary crank mechanism for providing a selectively adjustable force resistive to rotation of the hand actuated rotary crank mechanism.

DESCRIPTION OF THE PREFERRED EMBODIMENTS

Figure 1:
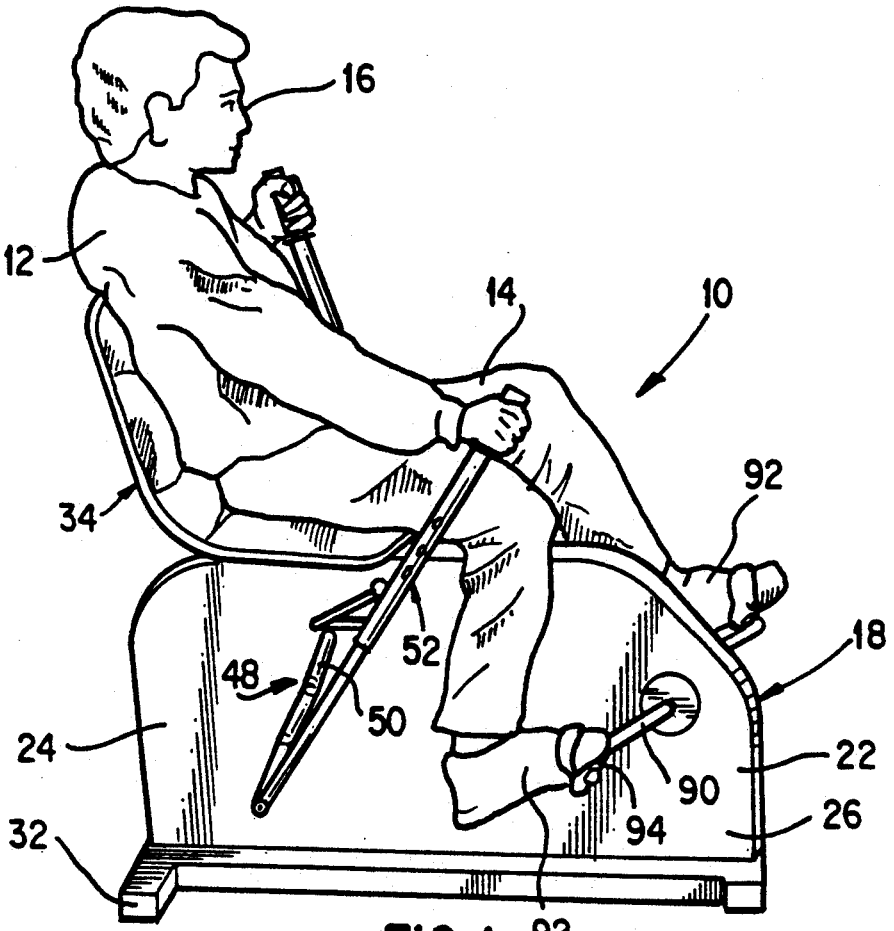
FIG. 1 is a perspective view of the body exercising apparatus of the subject invention concept.

Referring now to FIGS. 1–4, there is shown body exercising apparatus 10 for exercising both the upper body portions 12 and lower body portions 14 of a user 16. As will be described in following paragraphs, body exercising apparatus 10 provides for individual exercising of upper body portion 12 and lower body portions 14, or combinatorily providing exercising for both upper and lower body portions 12 and 14. Particular positioning and location of individual components of body exercising apparatus 10 allows differing muscle groups of user 16 to be activated in both an individual, as well as combinatorial manner, dependent upon the user's needs. In this manner, there is provided body exercising apparatus 10 which allows user 16 to be provided with a wide variety of force loading actions applied to specific areas of the body of user 16.

Body exercising apparatus 10 includes frame 18, which extends in longitudinal direction 20 and provides a frontal section 22 and an opposing rear section 24 displaced each from the other in longitudinal direction 20. Frame 18 includes opposing transverse sides 26 and 28 defining opposing sidewalls of frame 18. Additionally, as is more clearly seen in FIG. 3, frame 18 includes frame member 30 which is formed in an inverted substantially U-shaped contour. Frame member 30 is secured at a lower section thereof to body exercising apparatus base 32, which may be H-shaped in contour and is adapted to be mounted on a base surface (not shown). Base 32 is used as a stabilization member for providing interface with the base surface. Inverted U-shaped frame member 30 may be formed of steel or some like structural material composition not important to the inventive concept as herein described, with the exception that such be of sufficient structural integrity to accept the forces applied thereto. In similar manner, frame base 32 is formed of a material similar in nature and composition to inverted U-shaped contour frame member 30.

Body exercising apparatus 10 further includes seat 34 for supporting the upper body 12 and lower body 14 of user 16. Seat member 34 is displaceably coupled to an upper surface of frame 18 and is positionally mounted adjacent rear section 24, as clearly shown in FIG. 1.

In order to allow adjustable displacement in direction 20 for seat 34, seat 34 is attached through at least one plate 36 to a pair of seat rod members 38 movable within slot 40 of each of the frame plate members 42, each plate member 42 being disposed on opposing sides of frame member 30. Locking position of seat 34 within slot 40 is provided by seat locking member 44 through methods well-known in the art. In this manner, seat mechanism 34 may be displaceably moved in direction 20 and lockingly engaged to frame 18 at a desired position determined by user 16.

Figure 2:
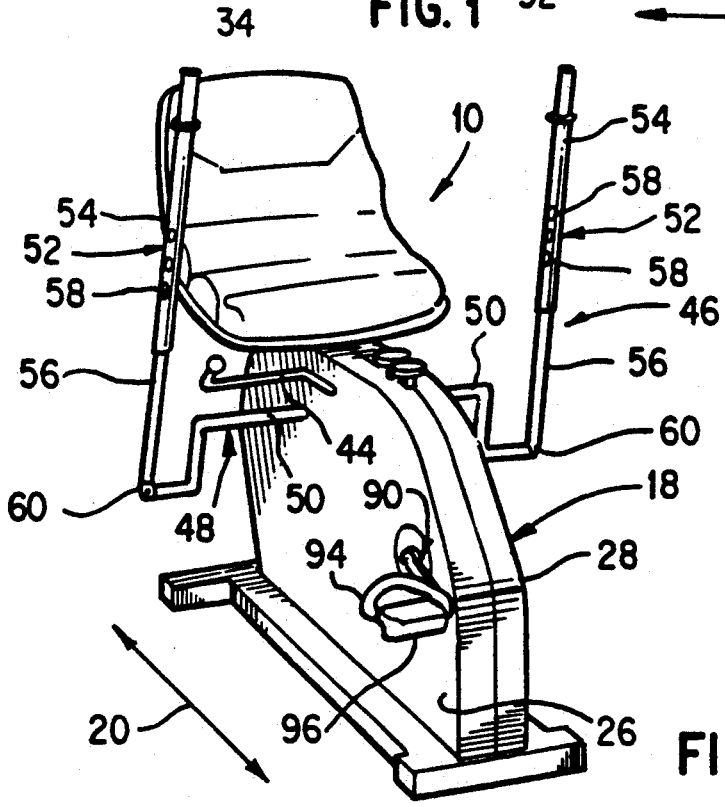
FIG. 2 is a frontal perspective view of the body exercising apparatus.

Upper body exercising mechanism 46 is positionally located adjacent rear section 24 of frame 18 and is particularly located substantially beneath seat mechanism 34 to thereby position the user's body with respect to mechanism 46 to optimize the motion of particular upper body muscle groups and maximize the effect of the exercise, which is of critical importance. Upper body exercising mechanism 46 includes hand actuated rotary crank mechanism 48 for rotation in either of two opposite rotary directions defined by an axis direction substantially normal to longitudinal direction 20. Hand actuated rotary crank mechanism 48 includes hand actuated rotary shafts 50 seen in FIGS. 1-3. Hand actuated rotary shafts 50 extend from opposing transverse sides 26 and 28 of frame 18 in a direction substantially perpendicular to longitudinal direction 20. Additionally, hand actuated rotary shafts 50 are substantially Z-shaped in contour to allow for rotational actuation of rotary crank mechanism 48 as shown in FIG. 1. Hand actuated rotary mechanism 48 further includes adjustable crank arm mechanism 52 which is pivotally coupled to hand actuated rotary shafts 50. Adjustable crank arm mechanism 52 includes a pair of elongated hand grip members 54 and a pair of respective hand driving members 56 coupled to respective rotary shafts 50, as is shown in FIGS. 1 and 2.

Hand driven members 56 are telescopically received within hand grip members 54 in an adjustable manner to allow for adjusting a dimensional length of the overall adjustable crank arm mechanism 52. Length adjustment of the combined hand grip members 54 and hand driven members 56 may be accomplished in a number of well-known techniques, however, one particular mode of fixed adjustment includes a plurality of through openings 58 formed through both hand grip members 54 and hand driven members 56 where particular openings 58 are aligned and a pin member passing therethrough to secure hand grip members 54 and hand driven members 56 in fixed position, each with respect to the other.

Hand actuated rotary shafts 50 are pivotally coupled to adjustable crank arm mechanism 52 through crank arm joint mechanism 60. Crank arm joint mechanism 60 may be of the type provided in U.S. Pat. No. 5,125,648, having common inventors with respect to this invention concept, and hereby incorporated by reference. Crank arm joint mechanism 60 allows for displacement of adjustable crank arm mechanism 52 with respect to hand actuated rotary shafts 50 in at least two planes of rotation. Thus, adjustable crank arm mechanism 52 may be rotated in a plane parallel to the transverse sides 26 and 28 of frame 18 or may be extended in a transverse direction substantially normal to longitudinal direction 20 to provide a differing force actuation on upper body 12 responsive to a rotative force applied by user 16 to hand actuated rotary crank mechanism 48. In this manner, user 16 has at his or her disposal a mechanism whereby a wide variety of force loads may be applied to different upper body portions 12 through use of a single overall exercising mechanism.

Figure 3:
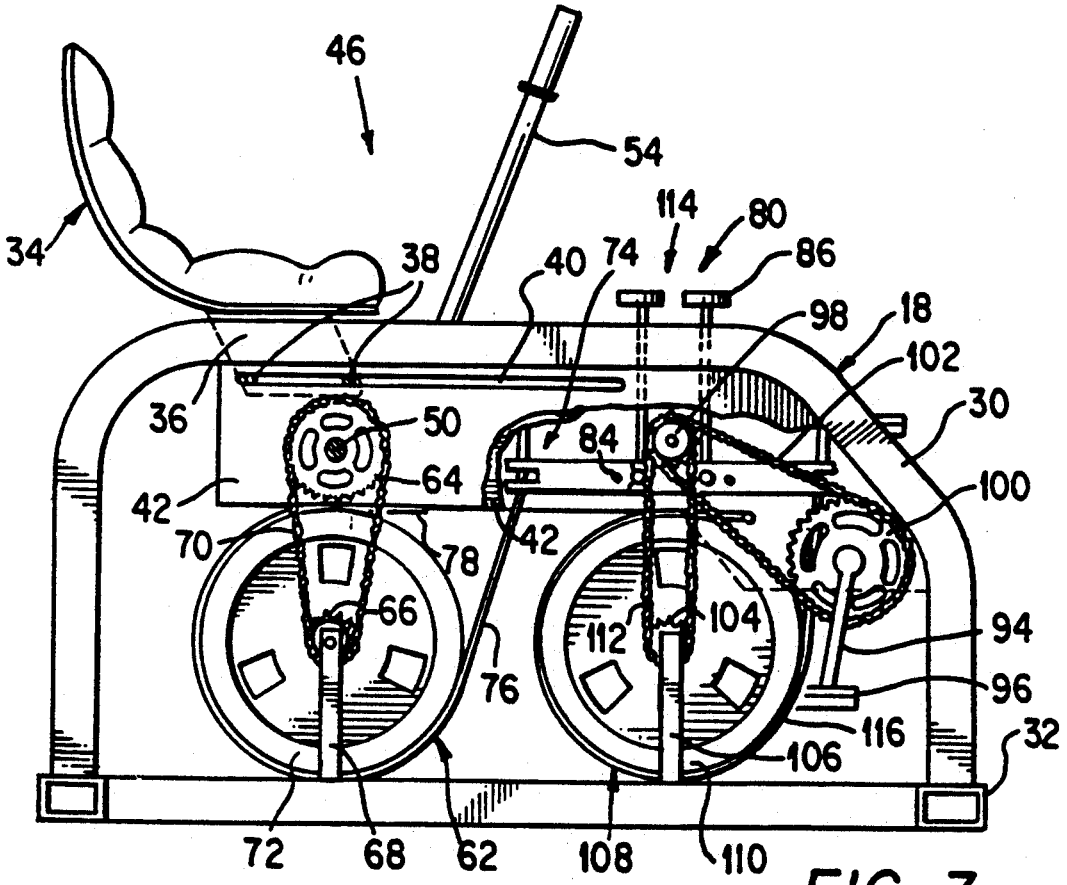
FIG. 3 is an elevational view of the body exercising apparatus showing the internal operating mechanisms of the subject invention concept; and, FIG. 4 is an elevational view partially cut away showing the frictional adjustment operating mechanism of the subject invention concept system.

Referring now to FIG. 3, upper body exercising mechanism 46 includes upper body resistance mechanism 62 which is coupled to hand actuated rotary crank mechanism 48 for providing a selectively adjustable force which is resistive to rotation of hand actuated rotary crank mechanism 48. Upper body resistance mechanism 62 includes first upper body sprocket wheel 64 which is fixedly secured to each of hand actuated rotary shafts 50 and rotatively responsive to rotation of shafts 50. Second upper body sprocket wheel 66 is rotatively secured to frame 18 through frame arm member 68 and is responsively rotated with respect to rotative displacement of first upper body sprocket wheel 64. First and second sprocket wheels 64 and 66 are coupled each to the other for responsive rotation by upper body chain member 70, as is shown. In this manner, as hand actuated crank mechanism 48 is rotated, there is a responsive rotation of rotary shafts 50 driving first upper body sprocket wheel 64 and second upper body sprocket wheel 66. Hand actuated rotary shafts 50 are mounted through frame plate members 42 through at least one bearing to allow responsive rotation thereof.

Upper body resistance mechanism 62 includes upper body rotatable member 72 which is fixedly coupled to second upper body sprocket wheel 66 in the manner shown in FIG. 3, and is rotationally displaceable therewith. Thus, upper body rotatable member 72 is provided with a responsive rotation when second upper body sprocket wheel 66 is rotated. There is further provided upper body adjustable resistance mechanism 74 secured to frame 18 and frictionally engageable with upper body rotatable member 72 for selectively adjusting a friction force applied to upper body rotatable member 72. Upper body adjustable resistance mechanism 74 further includes upper body band member 76 secured on a first end to frame 18 at frame securement section 78 and is in frictional contact with a peripheral surface or edge of upper body rotatable member 72, as is seen in FIG. 3. Upper body frictional adjustment mechanism 80 is coupled to frame 18 and upper body band member 76 for adjusting the frictional force between upper body rotatable member 72 and upper body band member 76.

Figure 4:
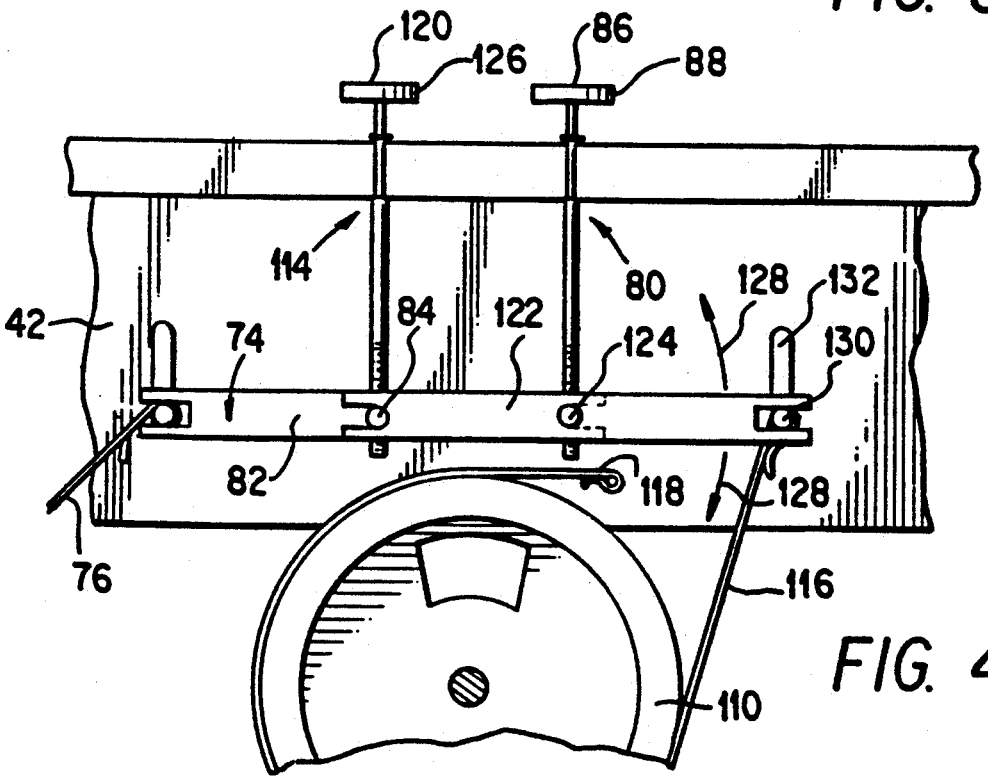

Upper body frictional adjustment mechanism 80 includes upper body lever member 82 which is pivotally secured to frame 18 about pivot point 84 as is seen in FIGS. 3 and 4. Body threaded driving member 86 as shown in FIGS. 3 and 4 is responsively or displaceably moved in a reversible vertical direction through rotation of upper body knob 88, upper body lever 82 is pivotally actuated about pivot point 84 and provides for adjustable tensioning force to be applied to upper body band member 76.

In this manner, the user has at his or her disposal a mechanism for increasing or decreasing the force necessary to actuate hand actuated rotary shafts 50 through rotation of hand actuated rotary crank mechanism 48. It is to be remembered that the particular orientation and angular relation of adjustable crank arm mechanism 52 permits the user to exercise various upper body portion muscles independently and in combinatorial manner responsive to a particular spatial orientation thereof.

Body exercising apparatus 10 further includes foot positioning mechanism 90 for positioning the user's feet 92. Foot positioning mechanism 90 is located adjacent frontal section 22 of frame 18 in longitudinally spaced relation with respect to seat mechanism 34. Foot positioning mechanism 90 includes user foot support members 94 which extend transverse from and are coupled to opposing transverse sides 26 and 28 of frame 18. User support members 94 define pedal members 96 which are rotatively coupled to opposing transverse sides 28 and 26, as previously described. Foot positioning mechanism 90 for positioning the user's feet adjacent front section 22 of frame 18 further includes first lower body sprocket wheel 98 rotatively coupled to frame 18 within plate members 42. There is further included second lower body sprocket wheel 100 which is rotatively coupled to first lower body sprocket wheel 98 as shown in FIG. 3. Second lower body sprocket wheel 100 is coupled to pedal members 96 for responsive rotation of second lower body sprocket wheel 100 with respect to a rotational driving force applied to pedal members 96 which are rigidly secured to second lower body sprocket wheel 100. Second lower body sprocket wheel 100 is coupled to first lower body sprocket wheel 94 through lower body chain member 102 for responsive rotation of members 98 and 100.

Third lower body sprocket wheel 104 is coupled in responsive rotation to first lower body sprocket wheel 98 and third lower body sprocket wheel 104 is rotatively coupled to frame 18 through lower body frame arm member 106.

Body exercising apparatus 10 further includes lower body resistance mechanism 108 for selectively adjusting a resistance force applied to and by pedal members 96. Lower body resistance mechanism 108 includes lower body rotatable member 110 which is fixedly coupled to third lower body sprocket wheel 104 and is rotationally displaceable responsive thereto. Third lower body sprocket wheel 104 is coupled to first lower body sprocket wheel 98 through second lower body chain member 112 to provide responsive rotation of third lower body sprocket wheel 104 as a function of the rotation of first lower body sprocket wheel 98. Lower body resistance mechanism 108 includes lower body frictional adjustment mechanism 114 secured to frame 18 and frictionally engageable with lower body rotatable member 110 for adjusting the frictional force applied to lower body rotatable member 110 responsive to rotative displacement of pedal members 96. Lower body adjustable resistance mechanism 114 includes lower body band member 116 secured on a first end to frame 18 at lower body securement point 118 as shown in FIG. 4, and is positioned in frictional contact with a peripheral side or edge of lower body rotatable member 110. Lower body frictional adjustment mechanism 114 is coupled to frame 18 and lower body band member 116 for adjusting the frictional force between lower body rotatable member 110 and lower body band member 116. Lower body frictional adjustment mechanism 114 includes lower body threaded driving mechanism 120 which displaces lower body lever member 122 about pivot point 124 to provide a reversible tensioning effect on band member 116. Rotation of lower body knob 126 thus allows the user to displace lower body lever member 122 in an arcuate direction as shown by arcuate arrows 128 and to provide a responsive tensioning in band 116 as band 116 is secured to the lever arm member 122 by pin member 130 movable in a vertical direction within slot 132 formed in plate members 42.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended Claims.

What is claimed is:

1. A body exercising apparatus comprising:

(a) a frame including a central frame member having an inverted substantially U-shaped contour, said frame having opposingly and longitudinally displaced front and rear sections;

(b) means for supporting the body of a user, said means coupled to an upper surface of said frame adjacent said rear section of said frame;

(c) means for positioning said user's feet adjacent said front section of said frame in longitudinally spaced relation with respect to said seat means; and, (d) means for exercising an upper body portion of said user, said means for exercising said upper body portion being positionally located adjacent said rear section of said frame substantially beneath said means for supporting said body of said user, said upper body exercising means including (1) independent hand actuated rotary crank means for rotation in either of two opposite rotary directions responsive to a rotary displacement of said user's arms for providing a rotary exercise motion of said user's arms independent of any motion of said user's lower body, said hand actuated rotary crank means including a pair of hand actuated rotary shafts having a substantially Z-shaped contour and extending from opposing transverse sides of said frame, and (2) upper body resistance means coupled to said hand actuated rotary crank means for providing a selectively adjustable force resistive to rotation of said hand actuated rotary crank means.

2. The body exercising apparatus as recited in claim 1 wherein said hand actuated rotary means includes adjustable crank arm means pivotally coupled to said hand actuated rotary shafts.

3. The body exercising apparatus as recited in claim 2 where said adjustable crank arm means includes an elongated hand grip member and a hand driving member coupled to each of said rotary shafts.

4. The body exercising apparatus as recited in claim 3 where said hand driven members are telescopically received within said hand grip members for adjusting a dimensional length of said adjustable crank arm means.

5. The body exercising apparatus as recited in claim 2 including crank arm joint means for coupling said hand actuated rotary shafts to said adjustable crank arm means.

6. The body exercising apparatus as recited in claim 5 wherein said crank arm joint means provides for displacement of said adjustable crank arm means with respect to said hand actuated rotary shafts in at least two planes of rotation.

7. The body exercising apparatus as recited in claim 1 where said upper body resistance means includes:

(a) a first body sprocket wheel being fixedly secured to each of said hand actuated rotary shafts; and, (b) a second upper body sprocket wheel rotatively secured to said frame and responsively rotated with respect to rotative displacement of said first upper body sprocket wheel.

8. The body exercising apparatus as recited in claim 7 where said upper body resistance means further includes:

(a) an upper body rotatable member fixedly coupled to said second upper body sprocket wheel for rotative displacement therewith; and, (b) upper body adjustable resistance means secured to said frame and frictionally engageable with said upper body rotatable member for selectively adjusting a friction force applied to said upper body rotatable member.

9. The body exercising apparatus as recited in claim 8 wherein said upper body adjustable resistance means includes:

(a) an upper body band member secured on a first end thereof to said frame and in frictional contact with a peripheral edge of said upper body rotatable member; and, (b) upper body frictional adjustment means coupled to said frame and said upper body band member for adjusting a frictional force between said upper body rotatable member and said upper body band member.

10. The body exercising apparatus as recited in claim 9, where said upper body frictional adjustable means includes an upper body lever member pivotally secured to said frame and coupled to one end of said upper body band member for displacing said upper body band member responsive to a rotative displacement of said upper body lever member.

11. The body exercising apparatus as recited in claim 1 where said means for positioning said user's feet includes a pair of user foot support members transversely extending from and coupled to opposing transverse sides of said frame.

12. The body exercising apparatus as recited in claim 11 where said user support members define a pair of pedal members rotatively coupled to said opposing transverse sides of said frame.

13. The body exercising apparatus as recited in claim 12 where said means for positioning said user's feet adjacent said front section of said frame includes:

(a) a first lower body sprocket wheel rotatively coupled to said frame; and, (b) a second lower body sprocket wheel rotatively coupled to said first lower body sprocket wheel, said second lower body sprocket wheel being coupled to said pair of pedal members for responsive rotation of said second lower body sprocket wheel with respect to a rotational driving force applied to said pedal members.

14. The body exercising apparatus as recited in claim 13 including a third lower body sprocket wheel coupled in responsive rotation to said first lower body sprocket wheel, said third lower body sprocket wheel being rotatively coupled to said frame.

15. The body exercising apparatus as recited in claim 12 further including lower body resistance means for selectively adjusting a resistance force applied to said pedal members.

16. The body exercising apparatus as recited in claim 14 where said lower body resistance means includes a lower body rotatable member fixedly coupled to said third lower body sprocket wheel for rotative displacement of said lower body rotatable member responsive to rotation of said third lower body sprocket wheel.

17. The body exercising apparatus as recited in claim 16 where said lower body resistance means includes lower body frictional adjustment means secured to said frame and frictionally engageable with said lower body rotatable member for adjusting a frictional force applied to said lower body rotatable member responsive to rotative displacement of said pedal members.

18. The body exercising apparatus as recited in claim 17 wherein said lower body adjustable resistance means includes:

(a) a lower body band member secured on a first end thereof to said frame and in frictional contact with a peripheral edge of said lower body rotatable member; and, (b) lower body frictional adjustment means coupled to said frame and said lower body band member for adjusting a frictional force between said lower body rotatable member and said lower body band member.

* * * * *